US010065205B2

(12) United States Patent
Olegnowicz

(10) Patent No.: US 10,065,205 B2
(45) Date of Patent: Sep. 4, 2018

(54) INTEGRATED LOCK FOR ATOMIZER

(71) Applicant: Israel Olegnowicz, Richmond (GB)

(72) Inventor: Israel Olegnowicz, Richmond (GB)

( * ) Notice: Subject to any disclaimer, the term of this patent is extended or adjusted under 35 U.S.C. 154(b) by 380 days.

(21) Appl. No.: 14/694,713

(22) Filed: Apr. 23, 2015

(65) Prior Publication Data

US 2015/0306617 A1 Oct. 29, 2015

Related U.S. Application Data

(60) Provisional application No. 61/983,050, filed on Apr. 23, 2014.

(51) Int. Cl.
*B05B 11/00* (2006.01)

(52) U.S. Cl.
CPC ..... *B05B 11/306* (2013.01); *B05B 11/0016* (2013.01); *B05B 11/3047* (2013.01); *B05B 11/3059* (2013.01)

(58) Field of Classification Search
CPC ..... B05B 11/0016; B05B 11/3047; B05B 11/3059; B05B 11/306; B65D 83/22; B65D 83/222
USPC ..... 222/153.01, 153.13, 321.1, 321.2, 222/321.7–321.9
See application file for complete search history.

(56) References Cited

U.S. PATENT DOCUMENTS 3,460,719 A * 8/1969 O'Donnell ..... B65D 83/205 222/320
3,474,939 A 10/1969 O'Donnell et al.
3,484,023 A * 12/1969 Meshberg ..... B65D 83/205 222/402.11
3,608,791 A * 9/1971 Jordan ..... B65D 83/205 222/402.11
4,324,351 A * 4/1982 Meshberg ..... B65D 83/205 222/402.11
4,479,589 A 10/1984 Ford
4,572,410 A * 2/1986 Brunet ..... B65D 83/205 222/402.1
4,589,574 A * 5/1986 Foster ..... B05B 11/306 222/153.13
4,735,346 A 4/1988 Stoody
4,830,224 A * 5/1989 Brison ..... B05B 11/3059 222/153.06
4,991,746 A * 2/1991 Schultz ..... A47K 5/1205 222/153.13
5,096,094 A * 3/1992 Guilbert ..... B05B 11/3001 222/153.13

(Continued)

*Primary Examiner* — Nicholas J Weiss
(74) *Attorney, Agent, or Firm* — Kimberly O Snead

(57) ABSTRACT

A liquid atomizer has an actuator, cap, piston unit and body. The actuator consists of an exterior casing, a locking block within the case, a nozzle and a piston receiving area that is in liquid communication with the nozzle. The cap has a pair of locking flanges separated by a locking channel dimensioned to receive the locking block as the actuator is depressed. A pair of stops, separated by a stop channel, prevent over rotation of the actuator. The piston unit has a piston whose proximal end has ribs and is dimensioned to be received within the ring containing piston receiving area in a juxtaposed manner. The dimensioning between the rings and the piston ribs permit disengagement, by the piston tilting under the rotational pressure enough to permit the actuator to lift slightly in order to clear the locking flanges.

17 Claims, 6 Drawing Sheets

(56) References Cited

U.S. PATENT DOCUMENTS

| | | | | | |
|---|---|---|---|---|---|
| 5,158,206 | A * | 10/1992 | Kobayashi | B65D 47/261 | 222/153.11 |
| 5,379,924 | A * | 1/1995 | Taylor | B65D 83/205 | 222/402.11 |
| 5,388,730 | A * | 2/1995 | Abbott | B65D 83/205 | 222/153.13 |
| 5,518,147 | A * | 5/1996 | Peterson | B05B 11/3035 | 222/153.07 |
| 5,615,806 | A * | 4/1997 | Grothoff | B05B 11/3059 | 222/153.13 |
| 5,971,215 | A | 10/1999 | Bartsch | | |
| 6,065,647 | A * | 5/2000 | Bliss, III | B05B 11/0029 | 222/153.02 |
| 6,186,365 | B1 | 2/2001 | DeJonge | | |
| 6,523,722 | B1 | 2/2003 | Clark et al. | | |
| 6,601,735 | B2 * | 8/2003 | Milian | B05B 11/0027 | 222/153.11 |
| 6,695,171 | B2 * | 2/2004 | Walters | B05B 11/3001 | 222/153.13 |
| 6,932,244 | B2 * | 8/2005 | Meshberg | B05B 11/0032 | 222/153.13 |
| 7,178,694 | B2 * | 2/2007 | Costa | B05B 11/0027 | 222/153.13 |
| 7,367,476 | B2 * | 5/2008 | Law | B05B 11/0018 | 222/153.06 |
| 8,042,709 | B2 * | 10/2011 | Duquet | B05B 11/0062 | 222/153.11 |
| 2009/0183744 | A1 | 7/2009 | Hayton et al. | | |
| 2011/0253749 | A1 | 10/2011 | Hygema | | |
| 2011/0297700 | A1 | 12/2011 | Santagiuliana | | |

* cited by examiner

INTEGRATED LOCK FOR ATOMIZER

FIELD OF THE INVENTION

The invention relates to an improved closure system for an atomizer that prevents the contents from being expelled unintentionally.

BACKGROUND OF THE INVENTION

Manual liquid dispensers of various sorts have been widely implemented in a variety of applications. One type of liquid dispenser is a manually operated pump that is arranged to dispense a liquid in a fine mist. Such liquid dispensers are commonly referred to as "atomizers", in that the liquid is dispensed in very small liquid droplets. A common application for such liquid spray dispensers is in the dispensing of fragrance.

Liquid spray dispensers typically utilize a reciprocating pump that is manually operated by an external force applied against a restorative force, such as an expansion spring, with the application and removal of the external force being sufficient to generate pressure changes in the liquid chamber of the dispenser to alternately cause liquid dispensation and intake of liquid for the next pumping cycle. Liquid forced under pressure through a spray nozzle generates a dispersed mist of very small liquid droplets. Typically, liquid spray dispensers of this type comprise a pump mechanism which contains a liquid chamber, and a piston that is manually reciprocated in the pump mechanism. The piston is mounted for reciprocating movement in the liquid chamber, such that movement of the pump against a spring force causes the piston to move in the liquid chamber to thereby exert a compression force on the liquid in the chamber. Such force causes the liquid to move through a liquid passage to the spray outlet. Release of the external downward force to the pump permits the spring to expand under its restorative force, and to thereby return the pumping mechanism to its extended position. This movement of the pump mechanism causes the piston to move in the liquid chamber in a manner which expands the interior volume of the chamber. The negative pressure created by such movement draws liquid into the liquid chamber. Valve assemblies are typically employed in controlling the flow of liquid into the liquid chamber as its interior volume is increased by the movement of the pump mechanism.

Small atomizers are advantageous for conveniently carrying liquids, such as perfumes, in a pocketbook, pocket, car, etc. The disadvantage to the prior art small atomizers is the need for a top to prevent unwanted dispensing of the liquid.

SUMMARY OF THE INVENTION

Figure 1:
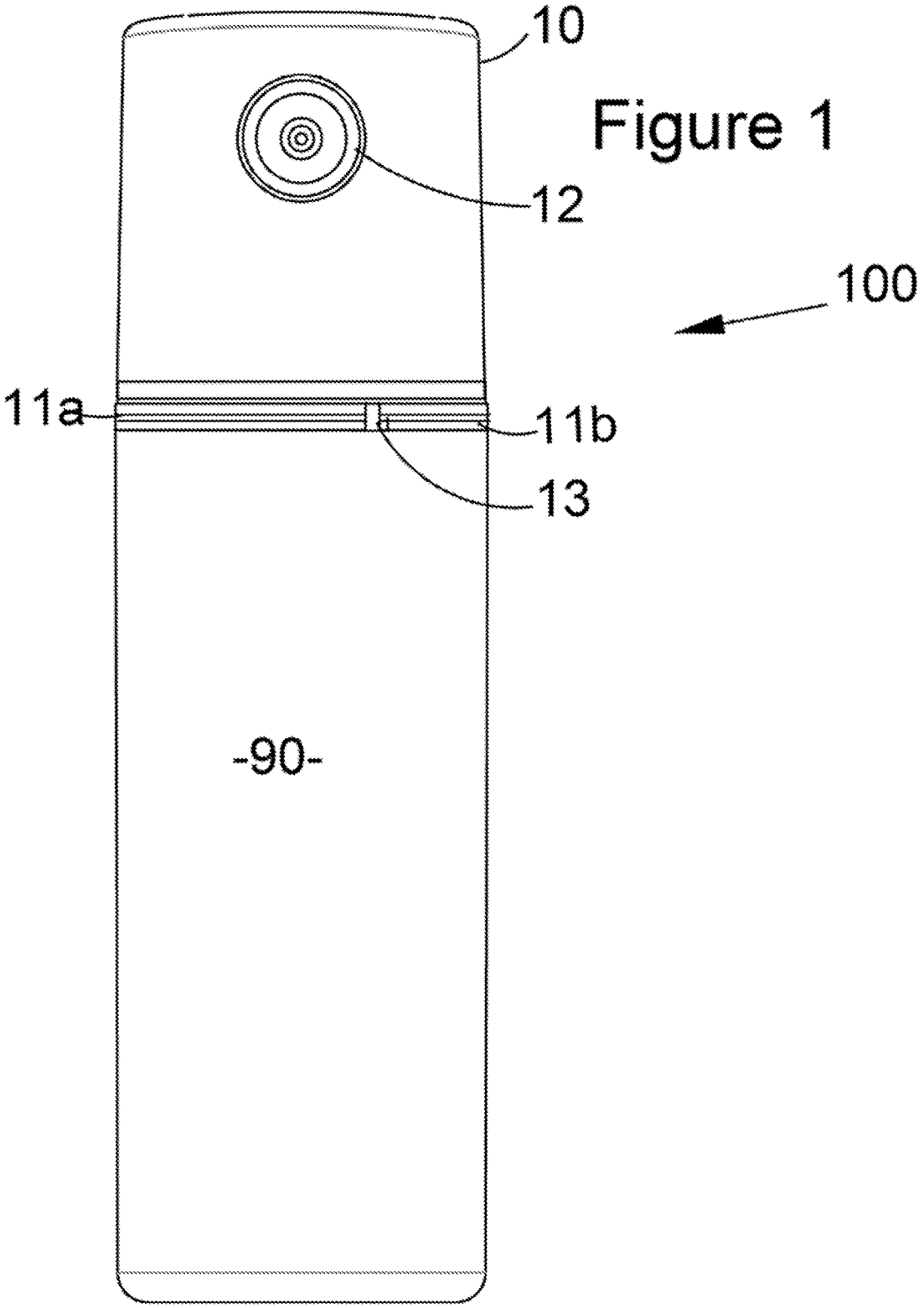
FIG. 1 is front view of the atomizer in accordance with the present invention.

A liquid atomizer has an actuator, cap, piston unit and body. The actuator consists of an exterior casing, a locking block within the case, a nozzle and a piston receiving area that is in liquid communication with the nozzle. A tab extends between the exterior casing and the piston receiving area opposite said nozzle, extending into said stop channel during compression of the actuator.

The cap consists of an open body having at least one locking flange with an adjacent locking channel. In some embodiments, where only one locking flange to permit rotation in a single direction, the stop extends to the locking channel. In embodiments where there are a pair of locking flanges they are separated by the locking channel. The locking channel is dimensioned to receive the locking block as the actuator is depressed. In embodiments where two locking flanges are used for bi-directional rotation, a pair of stops, separated by a stop channel opposite the locking channel, prevent over rotation of the actuator. In embodiments with a single direction of rotation only one stop is required. One or two rims, depending on the number of locking flanges and stops, separate the locking flanges and stops. A central tube receiving area is dimensioned to receive the piston from the piston unit. When two locking flanges are used they extend into the actuator on either side of the locking block and are dimensioned to prevent the locking block from inadvertent rotation. With a single locking flange it extends into the actuator on the side of rotation. Intentional lateral movement to the actuator rotates the locking block the locking flanges to slide along the rim and contact one of the stops.

The piston unit has a piston, a spring housing and a transfer tube. The proximal end of the piston is dimensioned to be received in the tube receiving area and has ribs that interact with rings within the piston receiving area in a juxtaposed manner. The dimensioning between the rings and the piston ribs permit disengagement, by the piston tilting under the rotational pressure enough to permit the actuator to lift slightly in order to clear the locking flanges.

The body is being configured to contain liquid with an open first end and sealed second end. The open first end receives the transfer tube and is sealed by the spring housing. One method of sealing the open end of the body is to have interlocking rings on the exterior of the spring housing and the interior of the open end of the body. The interlocking rings permit the spring housing and body to be snapped together. A vent permits the escaping of air during the snapping action.

To use the atomizer liquid is placed in the body and the transfer tube inserted. The spring housing and the body are snapped, or otherwise sealed together to prevent leakage. The actuator is depressed and liquid is transferred, through the piston to the nozzle. To prevent dispensing of the liquid the actuator is rotated causing a locking block to contact a locking flange. The application of rotational pressure causes the ribs at the proximal end of the piston unit to disengage with the rings within the piston receiving area, tilting and lifting the actuator. This permits the locking block to pass over the locking flange to rest on the rim with further rotation halted by the locking block contacting one of the stops. This position prevents downward movement of the actuator by said locking block contacting said rim.

| Glossary | |
|---|---|
| 100 | atomizer |
| 10 | actuator |
| 11a | actuator Interlocking rings |
| 11b | body interlocking rings |
| 12 | nozzle |
| 13 | vent |
| 14 | Receiving hole |
| 18 | Piston receiving area |
| 20 | Dispensing area |
| 22 | Locking block |
| 24 | tab |
| 26 | Ringed receiving area |
| 30 | cap |
| 32 | Open body |
| 36a | stop |
| 36b | stop |
| 37 | Stop channel |
| 38a | Locking flange |
| 38b | Locking flange |
| 40 | Locking channel |
| 42 | Tube receiving area |
| 44 | rim |
| 52 | Spring housing |
| 54 | piston |
| 55 | Transfer tube |
| 56 | Piston proximal end |
| 57 | ribs |
| 90 | body |
| 110 | actuator |
| 122 | Nozzle support |
| 128 | Locking protrusion |

DETAILED DESCRIPTION OF THE INVENTION

Atomizers are used to dispense a number of viscous materials and a number of locking mechanisms have been developed to prevent accidentally dispensing the contents. However, most locking mechanisms have been design for larger dispensers and many do not have integral locking mechanisms as part of the structure. The herein is closed locking mechanism can be used on small sample atomizers, as well as full sized atomizers, and eliminates the need for a cap to prevent leakage.

Definitions:

As used herein the term "atomizer" shall refer to any device for emitting water, perfume or other liquids as a fine spray.

As used herein the term "actuator" shall refer to the portion of an atomizer that, when pressed, forces the liquid out the nozzle.

The assembled atomizer 100 is illustrated in FIG. 1 with the actuator 10, containing the nozzle 12, mounted on the body 90. The cap 50 is snap fitted to the body 90 at juxtaposed interlocking rings 11*a* on the cap and 11*b* on the body 90. In order to facilitate snapping together the caps 10 and the body 90, a vent 13 is used. The vent 13 is a space, generally perpendicular to the interlocking rings 11*a* and 11*b*, without rings that permits air to escape from the body 90. The dimensioning of the interlocking rings 11*a* and 11*b* must be such that the two units snap into one another without damage and prevent unintentional separation.

Figure 2:
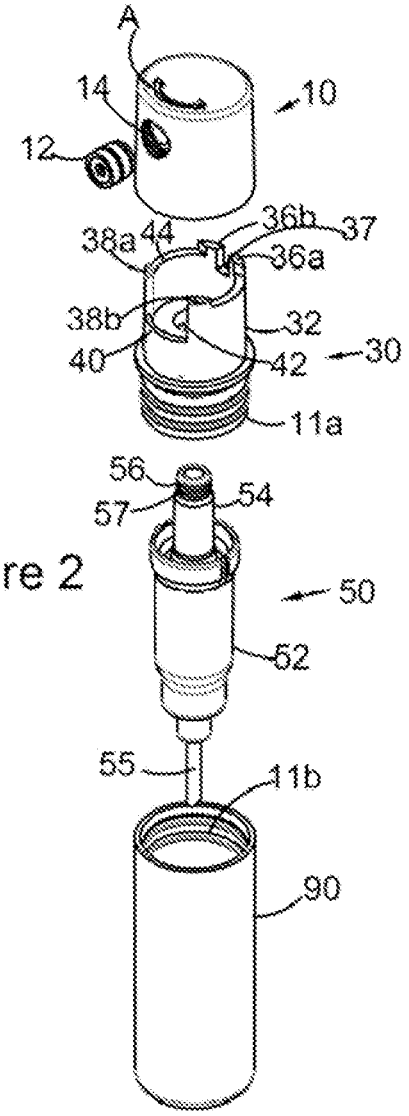
FIG. 2 is an exploded perspective view of the atomizer.

In FIG. 2, the interaction between these parts is more clearly illustrated. The actuator 10 is provided with a receiving hole 14 into which the nozzle 12 is secured. The interior of the actuator 10 and its locking mechanism, is described hereinafter in detail.

The open body 32 of the cap 30 illustrated in this embodiment contains the locking flanges 38*a* and 38*b* on either side of the actuator locking channel 40 and serves to lock the actuator 10 in the open or closed position as will be described herein. In the alternate embodiment, illustrated in FIG. 7, only one locking flange is used, restriction rotation to a single direction. Additionally, the stops 36*a* and 36*b* prevent the actuator 10 from rotating 360°. Between the stops 36*a* and 36*b* is the stop channel 37 that provides receiving space for the tab 24 (FIG. 3) during actuation. Without the clearance provided by the stop channel 37, the tab 24 would prevent the actuator 10 from full depression thereby limiting, or eliminating entirely, the quantity of liquid to be expelled. At the distal end of the cap 30 are the interlocking rings 11*a* that fit into the interlocking rings 11*b* of the body 90.

In the center of the open body 32 is the tube receiving area 42 that receives the piston 54 that in turn connects to the nozzle 12. The transfer tube 55, which is part of the piston unit 50, extends down into the body 90 and transfers the liquid contained therein to the nozzle 12. The proximal end 56 of the piston 54 contains ribs 57 to enable proximal end 56 to engage in a snap fit with the within the ringed receiving area 26 (illustrated in FIG. 5) of the piston receiving area 18. It is critical that the ribs 57 and the ringed receiving area 26 are dimensioned so that the receiving rings juxtapose the ribs 57 to lock the two pieces together. The spring housing 52 contains the spring mechanism that returns the piston 54 to the extended position. The depression of the actuator 10 compresses the piston 54, expelling the liquid within the transfer tube 55 out the nozzle 12 as known in the art.

Figure 3:
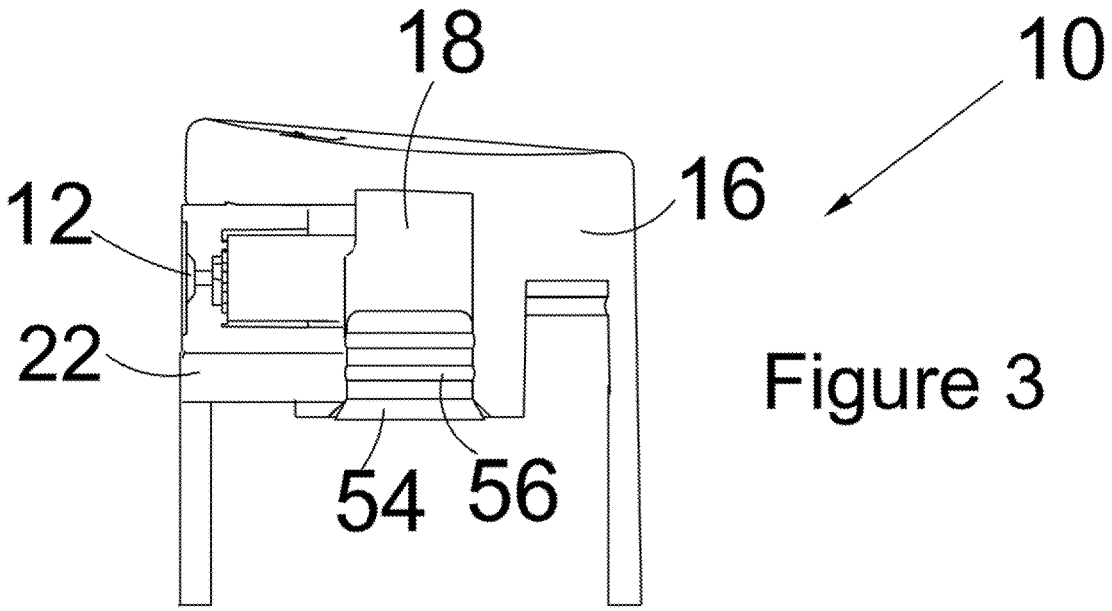
FIG. 3 is a cutaway side view of the actuator with the top of the piston tube in place, in accordance with the present invention.
Figure 5:
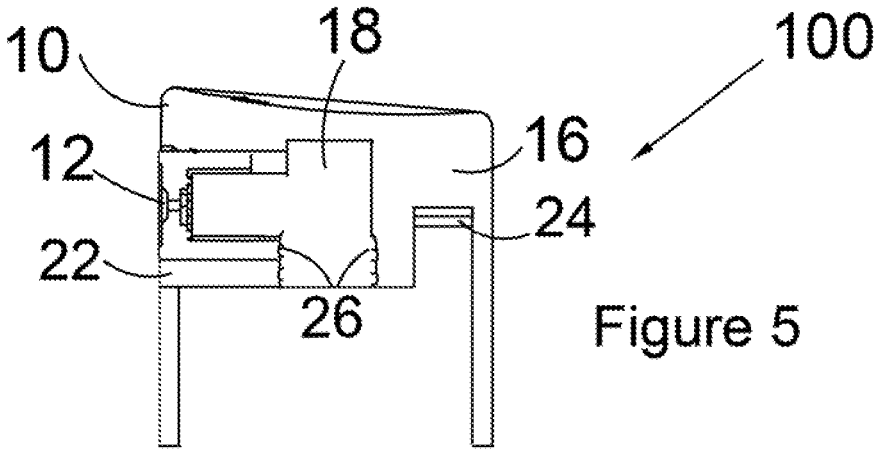
FIG. 5 is a cutaway side view of the actuator without the piston tube, in accordance with the present invention.

The actuator 10 locking mechanism is illustrated in FIGS. 3 and 5. As noted heretofore, the piston receiving area 18 is provided with a ringed receiving area 26 that is dimensioned to receive the ribs 57 of the proximal end 56 of the piston 54. The ringed receiving area 26 interacts with the ribs 57 to enable the actuator 10 to move along with the piston 54 without falling off. Although the ringed receiving area 26 prevents the actuator 10 from inadvertent removal, the dimensioning must not be so tight as to prevent the actuator's 10 ease of assembly onto, or removal from, the piston 54. The piston receiving area 18 is dimensioned to receive the piston 54 in a friction fit to prevent leakage.

The piston receiving area 18 extends into the dispensing area 20 which is in liquid communication with the nozzle 12. The locking block 22 surrounds the dispensing area 20 and is dimensioned to interact with the locking flanges 38*a* and 38*b* during rotation. The tab 24 serves as an aid in the molding of the actuator 10 and can have a different configuration, or be eliminated entirely, dependent on the method of manufacture. As noted above, however, if the tab 24 is used as a molding aid, its presence must be accommodated for by the stop channel 37.

As illustrated in the exploded view of FIG. 2 and assembled view of FIG. 5, the locking flanges 38*a* and 38*b* extend from the rim 44 of the body 32. The locking flanges 38*a* and 38*b* have a height dimensioned to enable the locking block 22, through slight disengagement from the piston stem 54, to pass over one of the locking flanges 38*a* or 38*b* and onto the rim 44 with intentional lateral movement. This lateral movement is allowed by the geometry and size of the opposing and interlocking between the ringed receiving area 26 (FIG. 5) in the piston receiving area 18 and the ribs 57 on the piston proximal end 56. The height preferably also provides the user with a tactile feeling of release upon return from the locked to the unlocked position. The dimensioning between the locking flanges 38*a* and 38*b* must also enable the locking block 22 to slide down while in an unlocked position, without unintended lateral movement, within the locking channel 40. The intentional lateral movement, in either direction as indicated by arrow A, should present only enough opposition to a lateral motion, intended to move the actuator to a locked position, to create ergonomic memory for the user. The dimensions of the locking channel 40 must be such that the locking block 22 can fully depress while still remaining compact.

Additionally, the height of the interference between flanges 38*a* and 38*b* and the locking block 22 is such that a lateral motion of the actuator is permitted by a simultaneous upward vertical motion of said actuator.

The tolerances between the parts involved with the locking of the actuator 10 are critical. If the interference is too great, it will not be able to be turned, but if it is too small, there is no lock, or a very poor lock.

The dimensions between the locking block 22 and the locking flanges 38*a* and 38*b* is important, as is the ability of the piston 54 to disengage from the actuator 10. The locking block 22 must be able to clear the rim 44 to enable the rotation of the actuator 10, however to prevent accidental locking or unlocking, the locking flanges 38*a* and 38*b* must provide some level of resistance. The resistance of the locking flanges 38*a* and 38*b* is overcome by the ability of the piston 54 to disengage from the actuator 10.

As the actuator 10 rotates, in either direction as indicated by arrow A, and the locking block 22 contacts the locking flanges 38*a* and 38*b* a resistance is met however continued slight pressure causes the piston 54 to tilt slightly and the actuator 10 to rise up slightly. This permits the locking block 22 to move beyond the locking flanges 38*a* and 38*b* to the rim 44.

Figure 4:
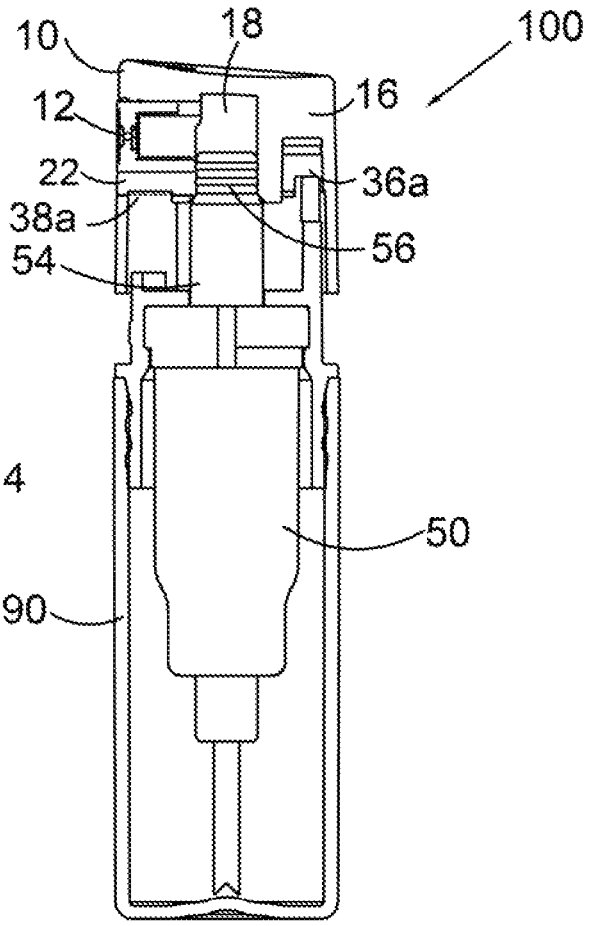
FIG. 4 is a cutaway side view of the atomizer in accordance with the present invention.
Figure 6:
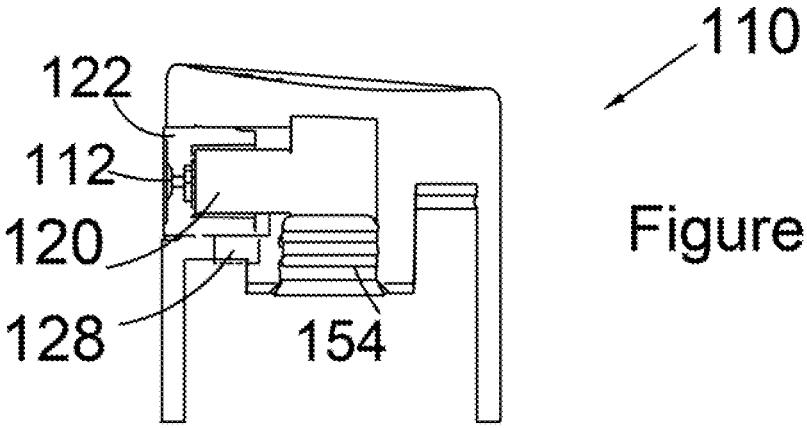
FIG. 6 is a cutaway side view of an alternate embodiment of the actuator, without the piston tube, have a locking projection, in accordance with the present invention.

In FIG. 6, rather than employing the locking block 22 of FIGS. 4 and 5, a nozzle support 122 and locking protrusion 128 are incorporated to prevent unwanted rotation of the actuator 110. The locking protrusion 128 is dimensioned to contact the locking flanges 38*a* and 38*b*, as noted heretofore, with a slight resistance that is overcome with sufficient pressure to cause the piston 154 to tilt slightly and the actuator 110 to rise up slightly. This permits the locking protrusion 122 to move beyond the locking flanges 38*a* and 38*b* to the rim 44. The nozzle support 122 is now a structural piece within which the nozzle 112 and dispensing area 120 are held. The remaining structure remains as described heretofore.

Figure 7:
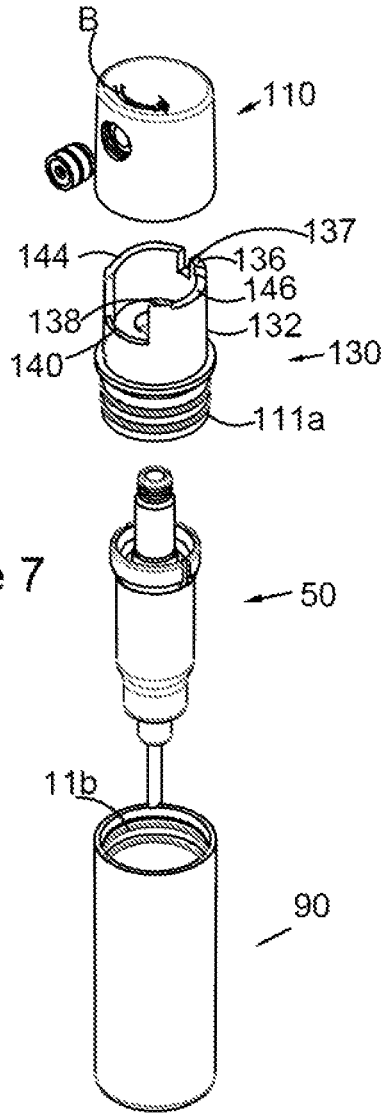
FIG. 7 is an alternate embodiment with the actuator rotating in a single direction, in accordance with the present invention.

In FIG. 7 the actuator 110 only rotates in a single direction, arrow B, making it more user friendly. The open body 132 of the cap 130 illustrated in this embodiment contains a single locking flange 138 on one side of the actuator locking channel 140 to rotate the actuator 110 in only one direction from the open to the closed position and back. The use of a single locking flange 138 prevents bi-rotational movement and simplifies not only use but manufacturing. The side rim 144 is a single edge extending from the locking channel 140 to the stop channel 137 and at the same height as the stop 136. Between the stop 136 and the side rim 144 is the stop channel 137 that provides receiving space for the tab 24 (FIG. 3) during actuation. Without the clearance provided by the stop channel 137, the tab 24 would prevent the actuator 110 from full depression thereby limiting, or eliminating entirely, the quantity of liquid to be expelled.

In operation, the cap 130 the same as the cap 30 described heretofore with the only difference being the rotation. This is advantageous in that only one part, the cap 30 or 130, needs to be changed in manufacture as the actuator 10, 110, piston unit 50 and body 90 remain the same. The only change in the actuator 110 of FIG. 7 and the actuator 10 is the arrow indicating the rotation direction which has been included for ease of illustration and is not a necessary element.

The assembled atomizer 100 is illustrated in FIG. 4 showing the in between the parts.

EXAMPLE I

Diameter of activator—0.483+/−0.005
Height of locking flanges—0.020+/−0.010 from rim
Height of locking channel area 0.211+/−0.010
Width of locking channel area—0.261+/−0.010

Although initially designed for small sample bottles, the foregoing can be applied to larger atomizers by increasing the dimensions. Thus, the dimensions set forth in the above example can be varied proportionally for various sizes of atomizers. The tolerances can remain the same, or adjusted slightly, but would not change proportionally with atomizer size variations in order to maintain clearances, as required.

Broad Scope of the Invention

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims (e.g., including that to be later added) are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language of the present invention or inventions should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure, the following abbreviated terminology may be employed: "e.g." which means "for example."

While in the foregoing we have disclosed embodiments of the invention in considerable detail, it will understood by those skilled in the art that many of these details may be varied without departing from the spirit and scope of the invention.

What is claimed is:

1. A liquid atomizer having:

a. an actuator, said actuator having:

i. an exterior casing:

ii. a locking block;

iii. a nozzle; and iv. a piston receiving area having receiving rings and being in liquid communication with said nozzle;

b. a cap, said cap having:

i. an open body having at least one locking flange, said at least one locking flange being dimensioned to enable said locking block to pass over said at least one locking flange by disengagement of a piston within said piston receiving area;

ii. a locking channel, said locking channel adjacent to said at least one locking flange and being dimensioned to receive said locking block;

iii. at least one stop;

iv. a stop channel; said stop channel opposing said locking channel and being adjacent to at least one of said at least one stop;

v. at least one rim, each of said at least one rim having a height less than said at least one locking flange and separating said at least one locking flange from said at least one stop;

vi. exterior connection means; and vii. a tube receiving area;

c. a piston unit, said piston unit having:

i. a piston, said piston having a proximal end and a distal end, said proximal end having piston ribs and being dimensioned to be received in said piston receiving area said piston ribs juxtaposing said receiving rings to movably secure said piston proximal end within said piston receiving area while enabling disengagement of said piston ribs within said receiving rings;

ii. a spring housing, said spring housing containing a spring mechanism to return said actuator to an extended position, and being dimensioned to be movably received in said tube receiving area;

iii. a transfer tube, d. a body, said body being configured to contain liquid and having:

i. an open first end, said open first end receiving said transfer tube and sealed closed by said spring housing;

ii. a sealed second end;

iii. interior connection means, said connection means being in locking engagement with said exterior connection means;

wherein said nozzle is in liquid communication with said body through said piston unit and compressing said actuator when said locking block is within said locking channel expels liquid contained in said body through said nozzle and rotation of said actuator places said locking block on one of said at least one rim, preventing said actuator from depressing.

2. The atomizer of claim 1 wherein said at least one rim is a first rim and an opposing second rim, said at least one locking flange is a first locking flange and an opposing second locking flange and said at least one stop is a first stop and an opposing second stop, wherein each of said first rim and said second rim has a height less than said first locking flange and said second locking flange, said first rim separating said first locking flange from said first stop and said second rim separating said second locking flange from said second stop.

3. The atomizer of claim 1 wherein said first rim and said second rim have a height sufficient to prevent rotation during depression of said actuator locking block.

4. The atomizer of claim 1 wherein said disengagement is enabled by said piston tilting under rotational pressure to cause said actuator to rise.

5. The atomizer of claim 1 wherein said at least one locking flange extends into said actuator adjacent to said locking channel and is dimensioned to prevent said locking block from inadvertent rotation within said cap.

6. The atomizer of claim 1 wherein intentional lateral movement to said actuator rotates said locking block over said at least one locking flange to slide along said at least one rim and contact said at least one stop enables the disengagement of said piston ribs within said piston receiving area.

7. The atomizer of claim 1 wherein said exterior connection means are interlocking rings and said interior connection means are compatible interlocking rings, said interlocking rings snapping together said cap and said body.

8. The atomizer of claim 1 further comprising a pair of vents, the first of said pair of vents being in said cap and a second of said pair of vents being in said body, said pair of vents aligning during assembly and permitting air to escape when snapping said cap and said body together.

9. The atomizer of claim 1 further comprising a tab, said tab extending between said exterior casing and said piston receiving area opposite said nozzle, said tab recessing into said stop channel during compression of said actuator.

10. The atomizer of claim 1 wherein said first locking flange extends above said first rim and said second locking flange extends above said rim about 0.02 inches.

11. A liquid atomizer having a. an actuator, said actuator having:

i. an exterior casing;

ii. a locking block;

iii. a nozzle; and iv. a piston receiving area, said piston receiving having rings and being in liquid communication with said nozzle;

b. a cap, said cap having:

i. an open body having at least one locking flange, said at least one locking flange extending into said actuator adjacent to said locking block to prevent said locking block from inadvertent rotation;

ii. a locking channel, said locking channel being adjacent to said at least one locking flange and being dimensioned to receive said locking block;

iii. at least one stop, iv. a stop channel; said stop channel opposing said locking channel and being adjacent to said at least one stop;

v. at least one rim comprising a first rim and a second rim, each of said at least one rim having a height less than said at least one locking flange and separating said at least one locking flange from said at least one stop, wherein said second of said at least one rim extending from said locking channel to said stop channel;

vi. interlocking rings on an exterior surface; and vii. a tube receiving area;

c. a piston unit, said piston unit having:

i. a piston, said piston having a proximal end, said piston proximal end having piston ribs, said piston ribs juxtaposing said rings within said piston receiving area of said actuator to maintain said piston proximal end movable within said piston receiving area while enabling disengagement of said piston ribs within said rings;

ii. a distal end, said proximal end being dimensioned to be received in a spring housing;

iii. a spring housing, said spring housing having a spring mechanism to return said actuator to an extended position, and being dimensioned to be movably received within said tube receiving area; and iv. a transfer tube;

d. a body, said body being configured to contain liquid and having:

i. an open first end, said open first end receiving said transfer tube and interlocking rings on an interior surface, said interlocking rings interacting with said interlocking rings on said cap to seal said cap and said body together;

ii. a sealed second end, wherein said nozzle is in liquid communication with said body through said transfer tube and compressing said actuator when said locking block is within said locking channel expels liquid contained in said body through said nozzle and when said locking block is rotated to rest on said at least one rim, said actuator is prevented from depressing.

12. The atomizer of claim 11 wherein said disengagement is caused by said piston tilting under rotational pressure enabling said actuator to rise.

13. The atomizer of claim 11 wherein intentional lateral movement of said actuator to rotate said locking block over a first of said at least one locking flange to slide along a first of said at least one rim and contact a first of said at least one stop is enabled by the disengagement of said piston ribs within said rings.

14. The atomizer of claim 11 wherein said at least one locking flange comprises a first locking flange and a second locking flange, wherein said at least one stop comprises a first stop and a second stop, and wherein a portion of said second rim has a decreased height to form said second locking flange and said second stop.

15. The atomizer of claim 11 further comprising a pair of vents, the first of said pair of vents being in said cap and a second of said pair of vents being in said body, said pair of vents aligning during assembly and permitting air to escape when snapping said cap and said body together.

16. The atomizer of claim 11 further comprising a tab, said tab extending between said exterior casing and said piston receiving area opposite said nozzle, said tab extending into said stop channel during compression of said actuator.

17. The atomizer of claim 11 wherein said at least one locking flange extends above said at least one rim about 0.02 inches.

* * * * *